US006128979A

United States Patent [19]

Shepherd

[11] Patent Number: 6,128,979

[45] Date of Patent: Oct. 10, 2000

[54] ROOFING SHOVEL

[76] Inventor: John Shepherd, 308 Broad St., Middlebourne, W. Va. 26149

[21] Appl. No.: 09/145,292

[22] Filed: Sep. 2, 1998

Related U.S. Application Data

[63] Continuation-in-part of application No. 09/032,032, Feb. 27, 1998, Pat. No. 5,906,145.

[60] Provisional application No. 60/048,438, Jun. 2, 1997.

[51] Int. Cl.[7] ..... E04D 15/00

[52] U.S. Cl. ..... 81/45; 173/128; 173/211; 299/37.5

[58] Field of Search ..... 81/45, 46; 173/128, 173/211, 11, 13, 18; 299/37.5, 37.1, 37.3; 30/169, 170; 15/93.1

[56] References Cited

U.S. PATENT DOCUMENTS

| | | | |
|---|---|---|---|
| 2,197,154 | 4/1940 | Miller . | |
| 3,625,295 | 12/1971 | Gunning . | |
| 4,095,752 | 6/1978 | Pomeret et al. . | |
| 4,302,894 | 12/1981 | Emma . | |
| 4,505,340 | 3/1985 | Yantsen et al. . | |
| 4,858,503 | 8/1989 | Dike, Jr. . | |
| 4,932,480 | 6/1990 | Golsch | 227/130 |
| 5,009,131 | 4/1991 | Alto et al. . | |
| 5,076,119 | 12/1991 | Wenz . | |
| 5,098,165 | 3/1992 | Jacobs et al. . | |
| 5,280,676 | 1/1994 | Fieni | 30/170 |
| 5,287,582 | 2/1994 | Kawai et al. | 30/169 X |
| 5,741,047 | 4/1998 | Ordonez | 30/170 X |

FOREIGN PATENT DOCUMENTS

| | | |
|---|---|---|
| 925428 | 3/1955 | Germany . |
| 2300668 | 7/1974 | Germany . |

*Primary Examiner*—D. S. Meislin
*Attorney, Agent, or Firm*—Richard C. Litman

[57] ABSTRACT

A power assisted roofing shovel for removing shingles and attached nails from a roof to facilitate re-roofing. The shovel comprises a handle, a shovel blade, a trigger mechanism, and a mechanism for reciprocating the shovel blade. The mechanism for reciprocating the shovel blade may be an air hammer, an electric motor, a solenoid, or other power assisted device. The handle is an elongate hollow cylinder having the trigger mechanism attached to its rearward end, the shovel blade attached to its forward end, and a reciprocating mechanism there between. The shovel blade has a generally flat leading edge adapted for removing roofing materials and a rearward shank. A bracket member, extending rearward from the shovel blade, is adapted to slidably connect the shovel blade and the handle for reciprocal movement of the shovel blade.

10 Claims, 6 Drawing Sheets

ROOFING SHOVEL

CROSS REFERENCES TO RELATED APPLICATIONS

This is a continuation-in-part of application Ser. No. 09/032,032, filed Feb. 27, 1998 now U.S. Pat. No. 5,906, 145, claiming the benefit of U.S. Provisional Application No. 60/048,438, filed Jun. 2, 1997.

BACKGROUND OF THE INVENTION

1. Field of the Invention

The present invention relates to a power tools, and particularly to a roof shovel. More specifically, the invention relates to a power shovel for removing shingles and attached nails from a roof to facilitate re-roofing, which shovel may be pneumatically or electrically actuated.

2. Description of Related Art

Commonly, when a house or other building has to be re-roofed, it is necessary to first remove the existing roof materials. Removing these materials, namely the shingles and nails attaching them to the existing roof structure, is a difficult process which has traditionally been accomplished by forcing a shovel or a similar tool under the shingles to pry them loose along with the attached nails.

This requires a great deal of physical exertion and often results in many of the nails either being forcefully ejected from the roof structure so that they pose a danger as they fly through the air, or, remaining embedded in the roof structure so that they must be removed from the roof structure separately of the shingles. In either case the task of cleaning up the removed roofing materials is made more difficult because the nails have been separated from the shingles while being removed.

One way to reduce the effort involved and the tendency of the nails to be separated from the shingles during the removal of the roofing materials is to utilize vibrating or reciprocating and otherwise movable shovel type elements driven by a variety of power sources to pry the shingles and attached nails from the roof structure. A number of tools having shovel type elements of the above described type have been disclosed in the prior art.

U.S. Pat. No. 4,095,752, issued Jun. 20, 1978 to Jean-Claude Pomeret and Henry Bonnevaux, discloses a motorized shovel apparatus having a cart mounted swiveling support arm, a pneumatic motor driven winch assembly, and a shovel with a pneumatic vibrator disposed between the handle and the shovel blade. The shovel, which is suspended from the winch assembly on the support arm, has controls in its handle adapted to operate the pneumatic motor driven winch assembly and the pneumatic vibrator so that the shovel may be easily operated with a minimum of physical effort. The apparatus of Pomeret and Bonnevaux is intended to be used to dig holes in the ground in cases where the use of a large mechanical shovel is not economical or is not possible due to lack of space.

U.S. Pat. No. 5,009,131, issued Apr. 23, 1991 to Brian J. Alto and Gregory F. Alto, discloses a long handled tool adapted for stripping roof shingles which utilizes a reciprocating blade slidably mounted over a shingle lifting plate to pry shingles from a roof structure and cut the shingle nails. When a trigger on the end of the handle of the tool is squeezed, an electric motor and gearing assembly connected to an offset crank causes the blade to reciprocate along an axis perpendicular to the leading edge of the lifting plate. The tool is effective at removing shingles and nail heads, but leaves the body of the nail embedded in the roof structure.

German Patent Number 925,428, issued Mar. 21, 1955, discloses another device which utilizes a motor and gearing assembly connected to an offset crank to reciprocate a blade member in front of the device. The device is a hand held power scraper for cleaning plane surfaces.

U.S. Pat. No. 4,858,503, issued Aug. 22, 1989 to John H. Dike, Jr., discloses a long handled shingle removing tool having a pivoting shovel element on the bottom end of the handle which is actuated by a trigger on the top end of the handle. The shovel element is pivoted upwardly by a-pneumatic drive attached thereto to pry the shingles from the roof structure after the shovel element has been forced under a group of shingles.

U.S. Pat. No. 5,076,119, issued Dec. 31, 1991 to Steven C. Wenz, discloses a roof shingle removing apparatus having a wheeled shovel like prying member with a blade attached to its forward edge. The blade on the apparatus of Wenz reciprocates along an axis parallel to the leading edge of the shovel-like member which is adapted to cut the nail heads to allow the shingles to be easily removed. The device has wheels and a deflector and cuts a wide path.

U.S. Pat. No. 5,098,165, issued Mar. 24, 1992 to James L. Jacobs and Larry D. Rogers, discloses a wheeled cart connected to a roof mounted guide system that allows the roof to be traversed at various positions along different travel paths. The cart has a reciprocating blade attached to its forward edge that follows the contour of the roof structure to dislodge shingles and nails therefrom. The apparatus of Jacobs and Rogers relies on an electric motor to reciprocate the blade and a complicated blade support assembly to insure that the blade follows the contours of the roof structure.

German Patent Number 2,300,668, issued Jan. 8, 1974, discloses another device for removing materials from a surface. The device includes a reciprocating plate which pries beneath the surface of the material being removed. The above mentioned device is specifically adapted for removing carpeting from a floor and has a spiked wheel and guide assembly which draws the carpet upward after it has been pried from the floor.

U.S. Pat. No. 4,302,894, issued Dec. 1, 1981 to Sam F. Emma, discloses a wheeled device having a long handle extending upward from its base and a movable shovel like member extending forward therefrom. The shovel member on the device of Emma is adapted to pivot downward to dump the material held in the shovel member. The device is manually operated and can be operated standing up without bending or stooping for shoveling snow and the like.

U.S. Pat. No. 3,625,295, issued Dec. 7, 1971 to Samuel D. Gunning, discloses an air hammer. U.S. Pat. No. 5,505,340, issued Mar. 19, 1985 to Yantzen et al. discloses a device adapted for breaking up concrete, asphalt, rock and the like in congested areas which uses a pneumatic chamber for biasing the handle in a neutral position and hydraulic power for reciprocating action.

However, none of the prior art discloses a shovel having a pneumatically driven reciprocating shovel blade or an electrically powered reciprocating shovel blade which is specifically adapted to remove roofing shingles and attached nails without separating them from each other.

None of the above inventions and patents, taken either singly or in combination, is seen to describe the instant invention as claimed.

SUMMARY OF THE INVENTION

The present invention is a shovel adapted to be used to remove roofing materials with significantly less effort than conventional means and without separating the majority of the nails from the shingles. The shovel comprises a handle, a shovel blade, a trigger mechanism, and a mechanism for reciprocating the shovel blade. The mechanism for reciprocating the shovel blade may be an air hammer, an electric motor, a solenoid, or other power assisted device. The handle is an elongate hollow cylinder having the trigger mechanism attached to its rearward end, the shovel blade attached to its forward end, and a reciprocating mechanism there between. The shovel blade has a generally flat leading edge adapted for removing roofing materials and a rearward shank. A bracket member, extending rearward from the shovel blade, is adapted to slidably connect the shovel blade and the handle for reciprocal movement of the shovel blade.

Accordingly, it is a principal object of the invention to provide a shovel having a vibrating shovel blade adapted to remove roofing materials.

It is another object of the invention to provide a shovel having a vibrating shovel blade driven by an air hammer connected to an external pneumatic power source.

Yet another object of the invention is to provide a shovel having a vibrating shovel blade driven electrically by an electric motor or by a solenoid in lieu of a pneumatic power source.

It is a further object of the invention to provide a shovel which enhances safety by allowing shingles and nails to be removed from a roof structure without separating the nails from the shingles, thereby eliminating potentially dangerous flying nails.

Still another object of the invention is to provide a shovel with a pneumatically driven vibrating blade which is easy to assemble and disassemble for repair and other purposes.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
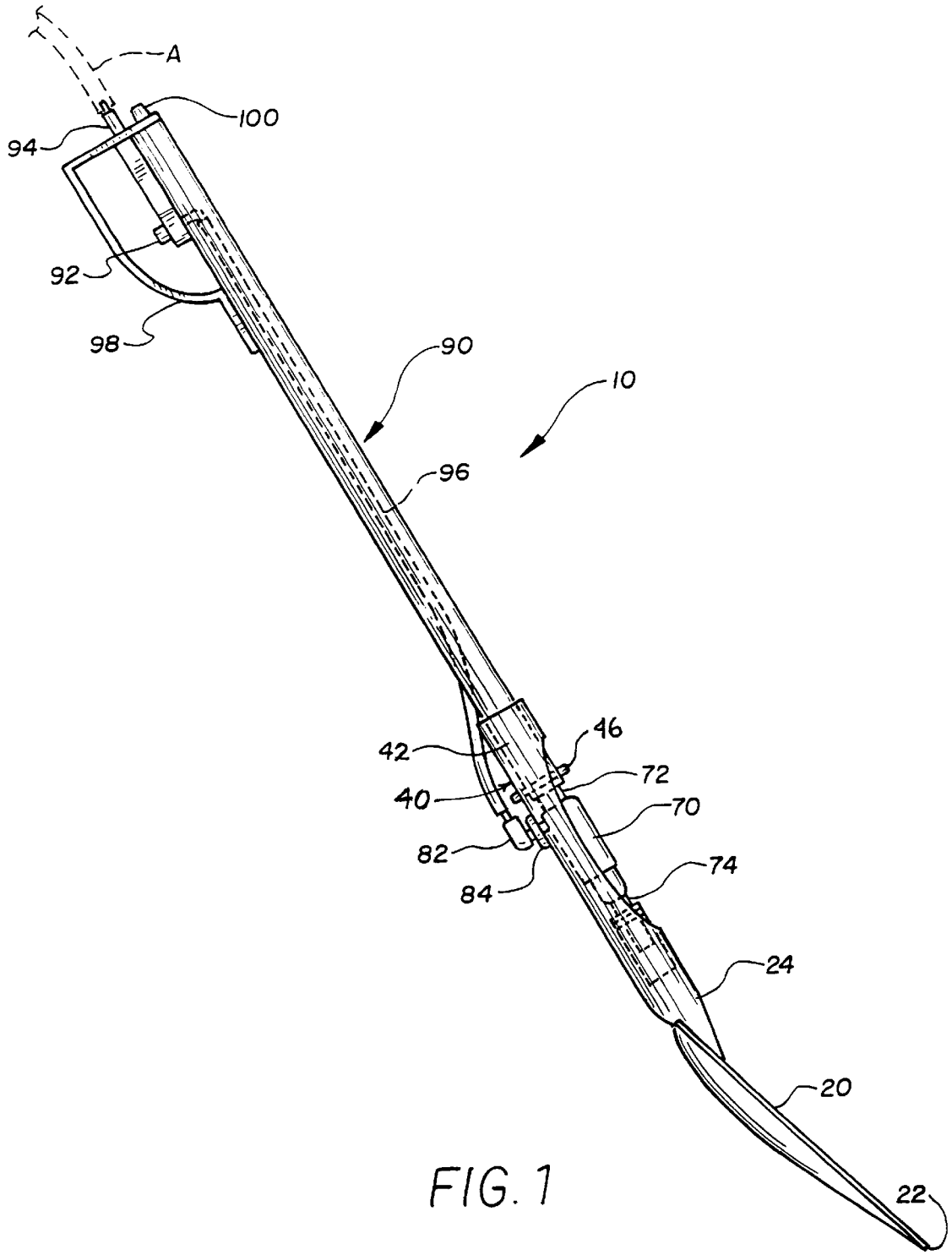
FIG. 1 is a perspective view of the roofing shovel of the present invention.

Referring to the drawings, FIG. 1 illustrates the pneumatically powered shovel 10 which is intended to be used to remove shingles and nails from an attached roof structure. The shovel 10 includes a handle 90, a shovel blade 20, a trigger mechanism 92, and an air hammer 70, arranged so that the air hammer 70 permits the shovel blade 20 to move rapidly in a reciprocating motion on the forward end of the handle 90 when the trigger mechanism 92 is squeezed.

The handle 90 forms an elongate hollow cylinder intended to be gripped adjacent its rearward end and having a bumper 72 made of an elastomeric material fixedly attached to its forward end. The bumper 72 may also be fitted to the air hammer 70. Disposed through the diameter of the handle 90 adjacent its forward end is a removable pin 46 which serves to hold the shovel blade 20 on the handle 90 in a manner to be described hereinafter.

Figure 2:
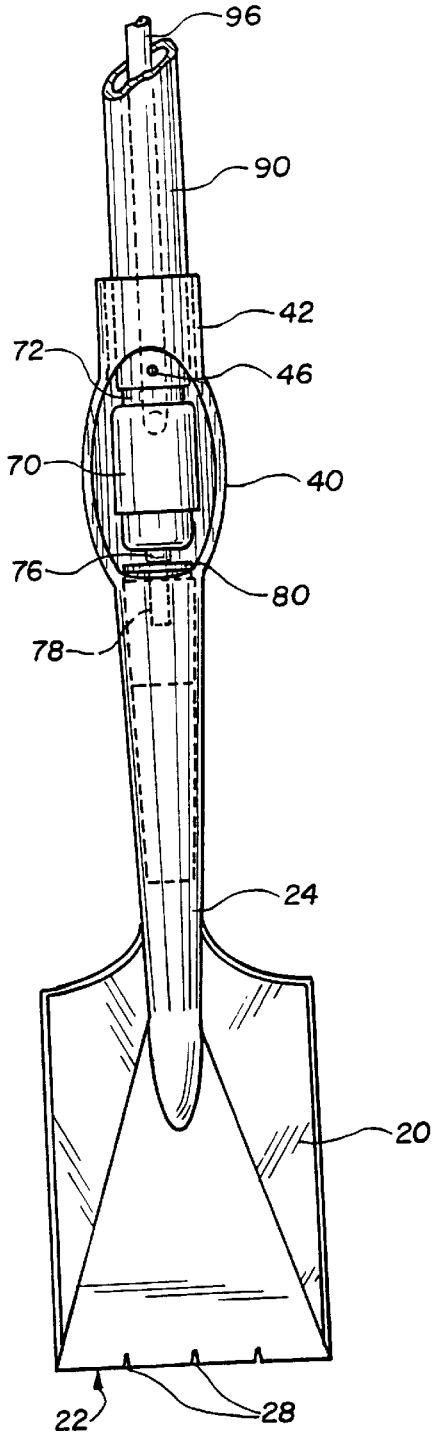
FIG. 2 is a front plan view of the roofing shovel of the present invention with the shovel blade in a normal position.
Figure 4:
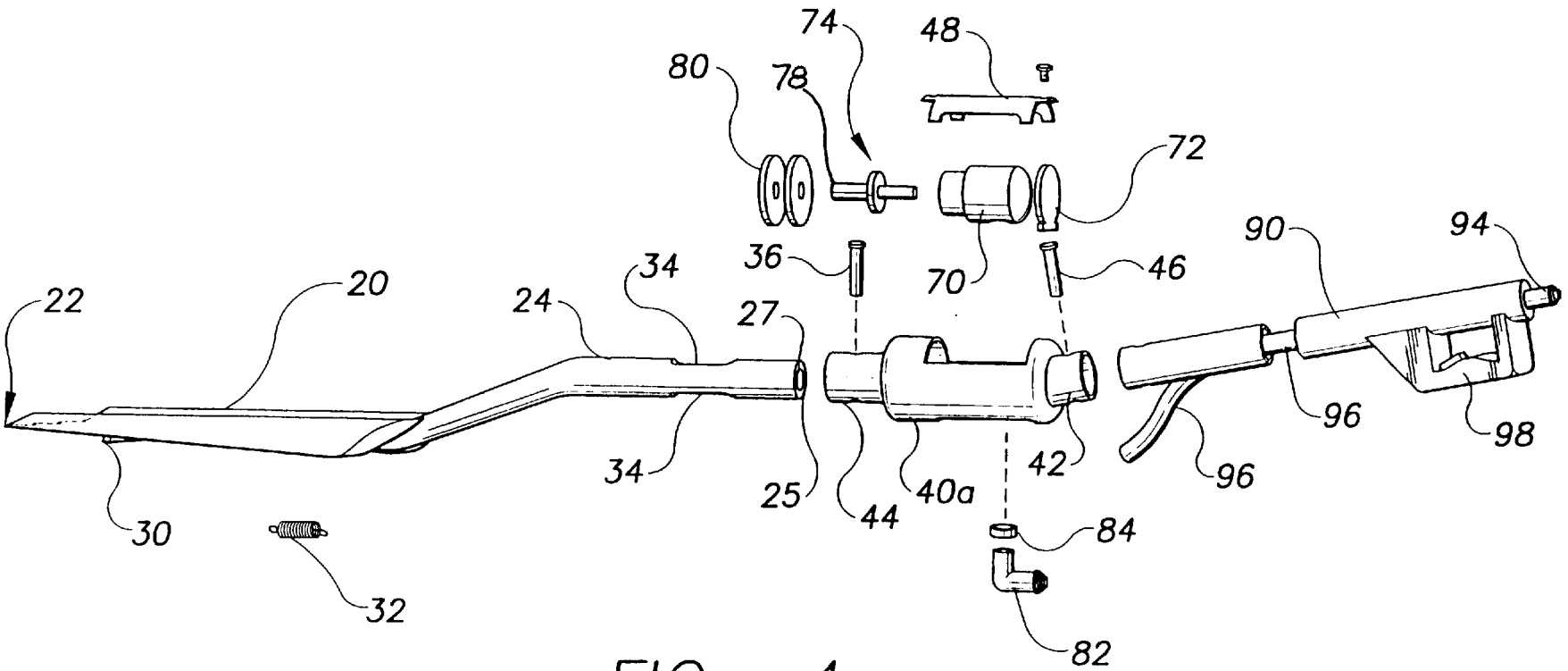
FIG. 4 is an exploded view of a preferred alternative embodiment of a roofing shovel of the present invention.

Referring now to FIGS. 2 and 4, the shovel blade 20 is specifically adapted for removing roofing materials in that it has a straight and flat leading edge 22 which is tapered to slide easily under a roof shingle. The leading edge 22 of the shovel blade 20 has a plurality of spaced notches 28 formed therein which may interfit with the shaft of a nail to facilitate its removal. The rearward end of the shovel blade 20 is in the form of a hollow and generally cylindrical shank 24 having a flange 25 with an aperture 27 defined therein welded into the free end of the shank.

Fixed to the rearward end of the shank 24 are a pair of brackets 40 which extend rearwardly therefrom. Together the brackets 40 define a substantially semicylindrical space which is open at its top side, as can be seen in FIG. 2, and which has a longitudinally running slot (not shown) along its bottom side. The brackets 40 are adapted to slidably support the air hammer 70 therebetween.

The rearward ends of the brackets 40 are integrally joined together for form a collar 42 having an internal diameter which is slightly larger than the diameter of the handle 90 and slightly smaller than the length of the pin 46. This arrangement allows the collar 42, and thereby the brackets 40 and the shovel blade 20, to be slidably supported on the handle 90 by placing the collar 42 around the forward end of the handle 90 and then inserting the pin 46 through the handle 90 in front of the collar 42 to prevent the collar 42 from sliding off the handle 90, the pin extending through the longitudinal slot in the bottom side of the collar 42. This can be understood from FIGS. 1 and 2 viewed together.

The air hammer 70 is placed between the brackets 40 so that the reciprocating drive rod 74 extending therefrom extends into the shank 24. The drive rod 74 has a base portion 76 and a distal end 78 having a smaller diameter than the base portion 76. Secured to the distal end 78 of the drive rod 74 are a pair of washers 80 having an internal diameter slightly greater than the diameter of the distal end 78 of the drive rod 74 and smaller than the diameter of the base portion 76 of the drive rod 74, and having an external diameter larger then the diameter of the aperture 27 of the shank 24 so that the washers 80 are sandwiched between the base portion 76 of the drive rod 74 and the flange 25 of the shank 24.

In order to cause the drive rod 74 of the air hammer 70 to reciprocate, the air hammer 70 must be connected to an external air line A. This is accomplished via the trigger mechanism 92 and an internal air line 96.

Referring back to FIG. 1, the trigger mechanism 92, which is fixed to the handle 90 adjacent the rearward end thereof, controls the flow of air from the external air line A into the internal air line 96. Extending from the rearward end of the trigger mechanism 92 is an air inlet 94 adapted to have the external air line A connected thereto. The internal air line 96 leads from the end of the trigger mechanism 92 opposite the air inlet 94, through the interior of the handle 90 to a point above collar 42, where the internal air line 96 exits the interior of the handle 90 to join an L-shaped pneumatic connector 82 adapted to be removably connected to the air hammer 70 through the slot between the bottom sides of the brackets 40. An elastomeric guard 84 is placed around the pneumatic connector 82 at the point where it passes through the slot to prevent unnecessary wear on the pneumatic connector 82. By connecting the air hammer 70 to the external air supply in the above described fashion, the drive rod 74 will move forward upon actuation of the trigger mechanism 92 which opens communication between a pressurized air source (i.e., a compressor) and the air hammer 70.

Also attached to the rearward end of the handle 90 is a guard 98 and an adjustable valve 100. The guard 98 extends around the trigger mechanism to prevent the accidental actuation thereof and the adjustable valve 100 is connected to the trigger mechanism 92 to regulate the amount of pressurized air to be vented from the trigger mechanism 92. This allows the pressure of the air in the internal air line 96 to be lowered, as desired, from the pressure of the air in the external air line A so that the operation of the air hammer 70 may be adjusted.

It should be noted that the shovel 10 may be easily disassembled because the L-shaped pneumatic connector 82 is removably connected to the air hammer 70, the pin 46 is removable, and the air hammer 70, drive rod 74, and washers 80 are not fixed to the brackets 40, the shank 24, or the handle 90. This allows maintenance or replacement of any of the shovel parts to be easily accomplished.

Figure 3:
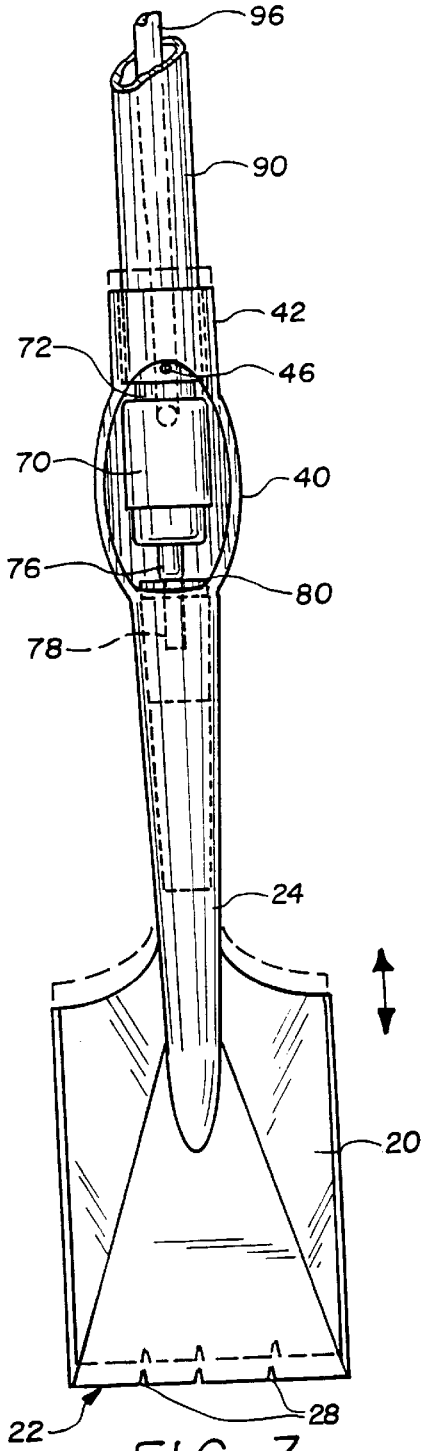
FIG. 3 is a front plan view of the roofing shovel of the present invention with the shovel blade in an extended position.

Referring now to FIG. 3, the operation of the shovel 10 may be described in the following manner. As the shovel 10 is pressed forward using the handle 90 to wedge the shovel blade 20 between a roof structure and a shingle attached thereto, the forward end of the handle 90 urges the air hammer 70 forward until washers 80 on the distal end 78 of the drive rod 74 are firmly sandwiched between the base portion 76 of the drive rod 74 and the flange 25 of the shank 24. This position is illustrated in FIG. 2 and in dashed lines in FIG. 3. At this point, when the trigger mechanism 92 is actuated, the drive rod 74 will move forward from the air hammer 70, forcing the washers 80 forward against the flange 25 of the shank 24 and thereby urging the shovel blade 20 forward and causing collar 42 to slide forward on the handle 90. This position is illustrated in solid lines in FIG. 3. Then as the drive rod 74 completes its reciprocating motion by moving backward into the air hammer 70, the forward pressure exerted on the handle 90 will cause the collar 42 to slide backward on the handle 90, thereby allowing the handle 90 to urge the air hammer 70 forward relative to the shank 24 until the washers 80 are again firmly sandwiched between the base portion 76 of the drive rod 74 and the flange 25 of the shank 24, thus completing the reciprocating motion of the shovel blade 20.

It will be apparent from the above description that the bracket 40 slidably engages the handle 90, the blade 20 being fixedly attached to the bracket 40, in order for the bracket 40 to engage in a reciprocating motion relative to the handle 90, thereby causing reciprocating movement of the blade 20. A second and preferred embodiment of the shovel 10 will now be described in which the bracket 40 is fixedly attached to the handle 90, while the shank 24 of the blade 20 is slidably attached to the bracket 40 so that the blade engages in reciprocating movement with respect to the bracket 40.

A preferred alternative embodiment of the roofing shovel of the present invention is shown in FIG. 4. As described above, a shovel blade 20 has a leading edge 22 adapted for removing roofing shingles and a rearward hollow shank 24. The bottom of the shovel blade 20 may be provided with a fulcrum 30 which is used in prying operations for greater leverage. The fulcrum 30 may be simply a small beam parallel to the leading edge 22 of the shovel blade, on which fulcrum the shovel blade 20 can pivot. The shank 24 has two longitudinal slots 34 located on the shank 24, 180° from each other. The rearward end of the shank 24 has a reinforced flange 25 welded to the outer rim of the shank 24, the flange 25 having a bore 27 defined therein slightly larger in diameter that the diameter of the distal end 78 of the drive rod 74. The shank 24 is fitted into a one-piece, hollow, cylindrical bracket **40*a*. At its forward end, the bracket 40*a* has a shank receiving collar 44 into which the shank 24 of the shovel blade 20 fits. The shank receiving collar 44 has two apertures spaced 180° apart around the circumference of the collar 44, each of which is aligned with one of the slots 34 on the shank 24. A pin 36 passes through one aperture, then through the shank 24, and finally through the other aperture. In this manner, the shovel blade 20 is slidably secured to the bracket 40*a* such that the blade 20 is free to reciprocate in a longitudinal direction between an extended position and a retracted position. A spring 32 passes within the shank 24 of the shovel blade 20 connecting a hook on the shovel blade 20 and the pin 36 to bias the shovel blade 20** in a retracted position.

The reciprocating motion of the shovel blade 20 is once again permitted by a drive rod 74 driven by an air hammer 70. The base end 76 of a drive rod 74, broadened by two washers 80, engages the flange 25 at the end of the shovel shank 24. The distal end 78 of the drive rod 74 is seated within the bore 27 of the flange 25 and driven by an air hammer 70 which is capped by a bumper 72. When the air hammer 70 is activated, the drive rod 74 is thrust forward, pushing the washers 80 against flange 25 of the shank 24 of the shovel blade 20, acting against the bias of the spring 32, to move the blade 20 to an extended position. As the air is exhausted from the chamber of the air hammer 70, the piston 74 retracts by contraction of the spring 32 so that the blade 20 returns to the retracted position and the cycle begins again. The entire drive arrangement is housed within the cylindrical bracket **40*a***.

The bracket **40*a* has a removable access panel 48 through which all components of the drive arrangement may be removed and replaced. Opposite the access panel 48 is a cutout for allowing for a connection 82 to an air hose 96 as previously discussed. Also important in this preferred embodiment is a handle receiving collar 42. A pin 46 fixedly attaches the handle 90 to the collar 42. This collar 42 is an integral part of the bracket 40*a*, found at its rearward end, adapted for receiving the handle 90 to complete the shovel 10. To reduce back strain, this collar 42 is, most preferably, angled slightly upward relative a longitudinal axis defined by the shank 24 of the shovel blade 20. The attached handle 90 contains an internal air hose 96** and associated parts, as previously discussed.

It will be understood that although in the preferred embodiment the roofing shovel 10 is pneumatically powered, the shovel 10 may be power actuated by any means conventional in the art, such as by an electric motor, by a solenoid, or by an internal combustion engine.

Figure 5:
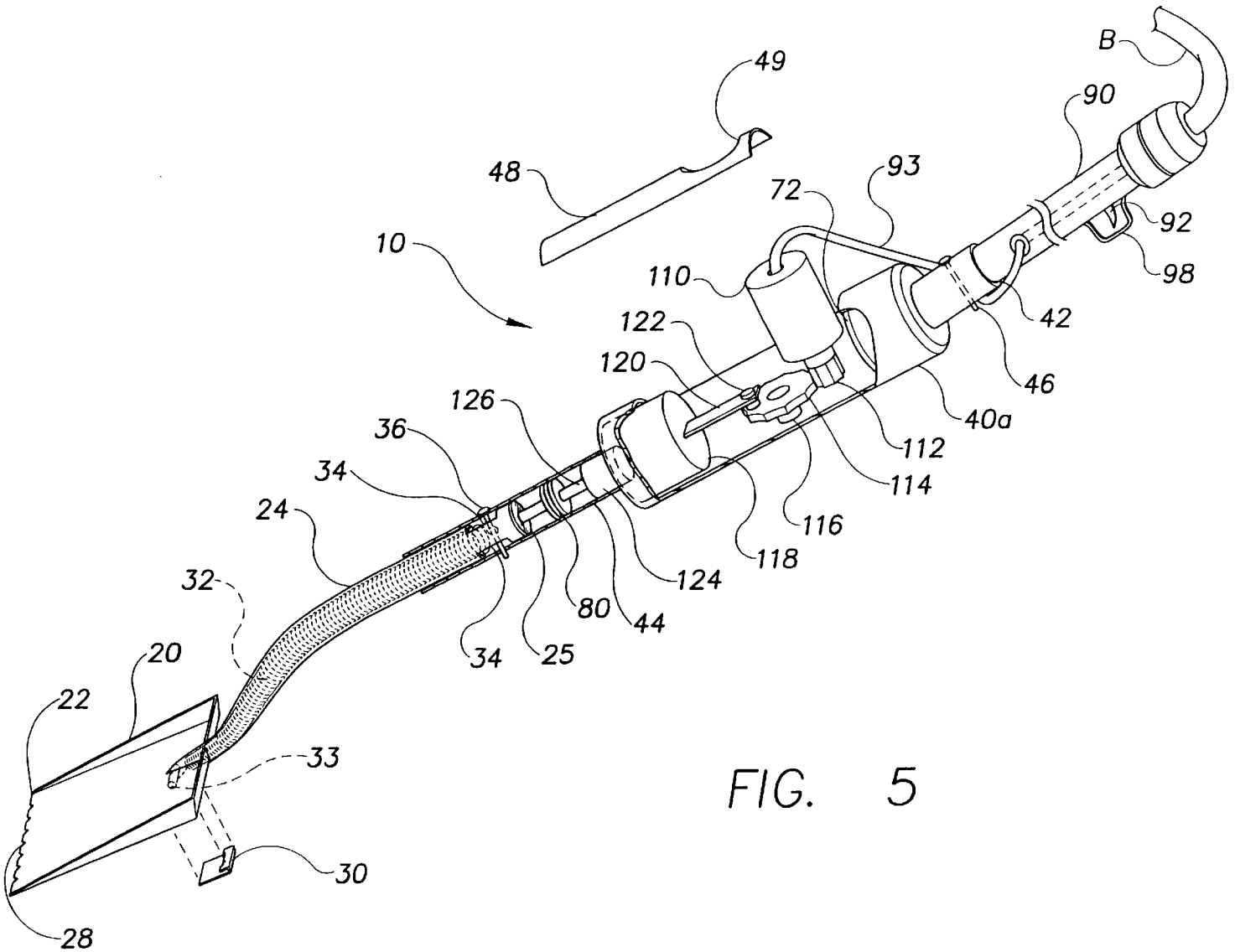
FIG. 5 is a fragmented, partially sectioned view of a third embodiment of a roofing shovel according to the present invention with some parts exploded and some parts cut away.

FIG. 5 shows an embodiment of the roofing shovel powered by an electric motor. As in FIG. 4, the shovel 10 has a hollow, cylindrical handle 90, a one-piece hollow bracket 40*a*, and a shovel blade 20. The handle 90 includes a trigger 92 and a trigger guard 98. The handle 90 is fixedly attached to the collar 42 of the bracket 40*a* by a pin 46 or other conventional means. As with the embodiment shown in FIG. 4, the collar 42 may be angled upwards relative to the body of the bracket 40*a* in order to reduce back strain.

As shown in FIG. 5, the bracket 40*a* has a hollow, cylindrical body with a bumper 72. At the end of the bracket 40*a* opposite its attachment to the handle 90, the bracket has a shank receiving collar 44 smaller in diameter than the body of the bracket 40*a*. The collar 44 has an inside diameter slightly greater than the outside diameter of the shank 24 of the shovel blade 20. The shank 24 of the shovel blade 20 is hollow, cylindrical, and has a pair of slots 34 extending longitudinally defined therein spaced apart by 180°. The shovel blade 20 is attached to the bracket 40*a* by a pin 36 which extends through a hole defined in the collar 44, the pair of longitudinal slots 34 defined in the shank 24 of the blade 20, and a second hole defined in the collar 44 of the bracket 40*a*. In this manner the shovel blade 20 is slidably attached to the bracket 40*a*.

A tension spring 32, as defined below, is attached to the shaft of the pin 36 and extends through the shank 24 of the blade 20, being attached at the other end to a hook 33 or pin welded transversely in a U-shaped channel or furrow on the bottom side of the shovel blade 20. The spring 32, in contraction, biases the shovel blade 20 in a retracted position. In this embodiment the fulcrum 30 is a heel plate welded to the bottom of the shovel blade 20 in such a manner as to cover and shield the attachment of the spring 32 to the hook 33. The blade 20 has a plurality of notches 28 defined in its substantially flat edge 22 adapted to engage nails retaining shingles.

The substantial difference between the embodiment shown in FIG. 5 and that shown in FIG. 4 is that the embodiment shown in FIG. 5 is powered by an electric motor 110. It will be understood that the motor 110 may translate the rotary motion of its armature or shaft 112 into motion of the shovel blade 20 by any means conventional in the art. The following description is intended for enablement purposes and not by way of limitation.

The motor 110 is mounted transversely in the bracket 40*a* by clamps or other means conventional in the art. The removable access panel 48 may have a hole 49 defined therein to accommodate and support the motor 110 housing, if necessary. The shaft 112 of the motor 110 is geared and adapted to engage a circular crank gear 114 mounted on a bearing 116. A hammer piston 118 is pivotally attached to the crank gear 114 by a connecting rod 120 and wrist pin 122. The opposite end of the connecting rod 120 is also pivotally connected to the hammer piston 118 by a wrist pin (not shown).

The hammer piston 118 is in abutting contact with a float piston 124. A plurality of washers 80 are fixedly mounted on the rod 126 of the floating piston 124. The free end of the rod extends through the bore 27 defined in the flange 25 welded to the outer rim of the shank 24 of the shovel blade 20.

The handle 90 has means adapted for connecting to a source of electrical power, by means of an extension cord B or otherwise. The handle 90 may have appropriate electrical wiring 93 connected to the trigger mechanism 92 and extending through the hollow body of the handle 90, exiting the handle 90 through a hole defined in the handle protected with a grommet, and connecting with the motor 110 either through a fixed solder connection, or through conventional quick connect electrical connectors known in the art.

In operation, the shovel blade 20 is normally biased in a retracted position by a helical spring 32. The helical spring is of the type wound tight to extend under axial tension, herein referred to as a tension spring, so that the spring contracts to return to its resting state. In the retracted position the flange 25 will push washers 80 on rod 126 to press floating piston 124 into abutting contact with hammer piston 118. The blade 20 of the shovel 10 is inserted beneath a shingle in conventional manner to engage the nails retaining the shingles in notches 28. An extension cord B being plugged into the handle 90 to connect the roofing shovel 10 to a source of electrical power, the trigger mechanism 92 is depressed, causing the shaft 112 and the crank gear 114 to rotate. As the connecting rod 120 rotates so that pin 122 is adjacent the motor 110, the blade is in the retracted position; but as the crank 114 rotates so that pin 122 is at its farthest point from the motor 110, as shown in FIG. 5, the hammer piston 118 presses floating piston 124 downwards in the collar 44 of the bracket 40*a* so that washers 80 press flange 25 of shank 24, forcing the blade 20 to an extended position against the contraction bias of spring 32. As the motor 110 continues to rotate so the wrist pin 122 is adjacent the motor 110, pressure on floating piston 124 is removed and the spring 32 biases the blade to the retracted position, causing the shovel blade 20 to reciprocate along the longitudinal axis of the shovel 10.

It will be understood that the housing of the electric motor 110 may have one or more switches for adjusting the speed or power of the motor 110 either continuously or stepwise, or appropriate circuitry to accomplish the same purpose may be connected to the trigger mechanism 92.

Figure 6:
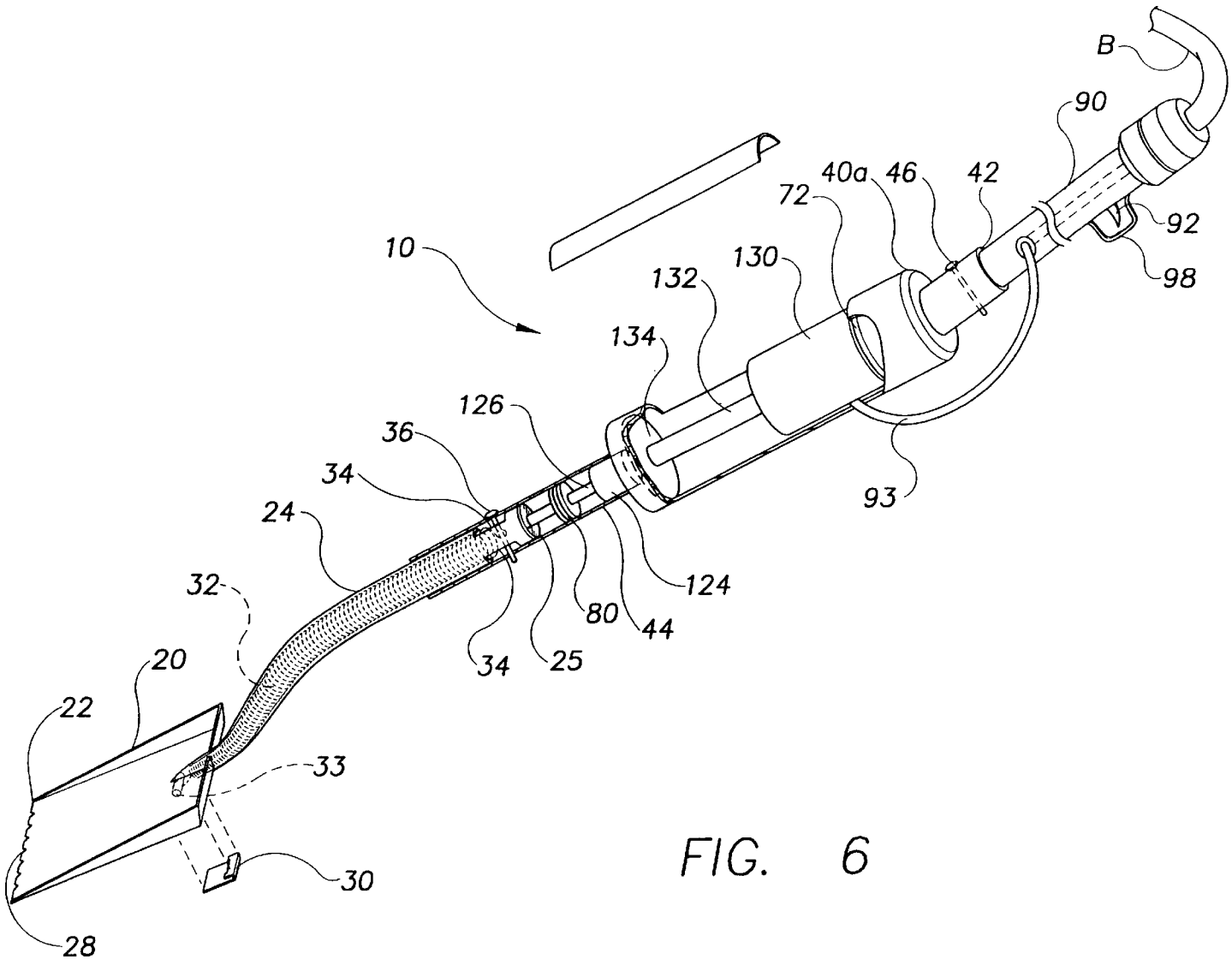
FIG. 6 is a fragmented, partially sectioned view of a fourth embodiment of a roofing shovel according to the present invention with some parts exploded and some parts cut away.
Figure 7:
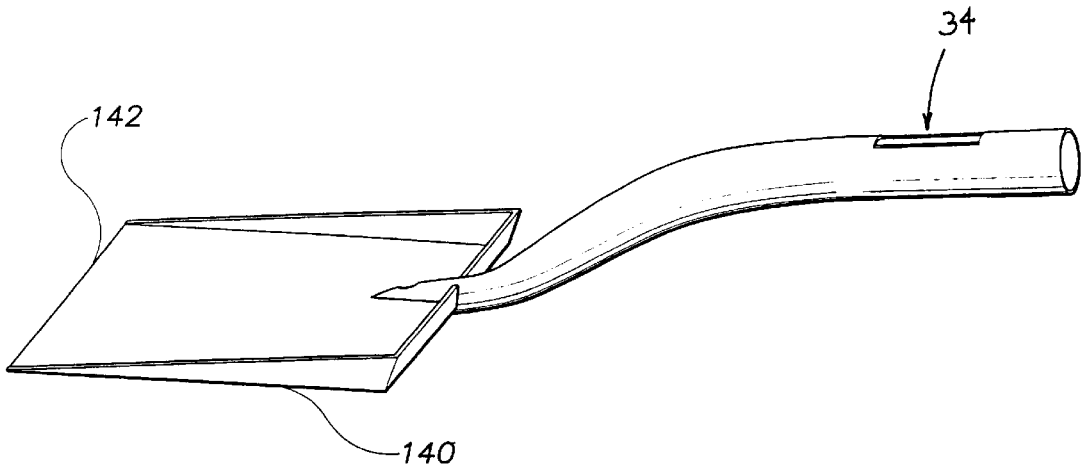
FIG. 7 is a perspective view of an alternative embodiment of a blade for use with the roofing shovel of the present invention.

A fourth embodiment is shown in FIG. 6. This embodiment is substantially identical to the embodiment shown in FIG. 5 except that the movement of the blade 20 is powered by a solenoid 130 and plunger 132 instead of an electric motor. The solenoid 130 may be disposed entirely within the bracket 40*a* with one end adjacent the bumper 72. The plunger 132 is disposed between the solenoid 130 and the floating piston 124 with the head 134 of the plunger 132 in abutting contact with the piston 124 and biased to maintain the shovel blade 20 in an extended position with no current applied to the solenoid 130, against the retracting bias of tension spring 32.

In operation, the blade 20 is placed under the shingle with the notched 28 edge 22 engaging the nails retaining the shingle. When power assistance is required, the trigger mechanism 92 is depressed, the handle 90 being connected to a source of electrical power through extension cord B. The coil being energized, the magnetic field of the solenoid 130 withdraws the plunger 132 into the core of the solenoid 130, relieving the pressure of the head 134 against the floating piston 124, and permitting spring 32 to move the blade 20 to a retracted position. As the current alternates and the magnetic field reverses, the plunger 132 returns to its normal extended position, the head 134 of the plunger 132 applying pressure to the floating piston 124 to extend the blade 20, the cycle repeating as long as the trigger 92 is depressed to impart a reciprocating motion to the blade 20 along the longitudinal axis of the shovel 10.

Figure 8:
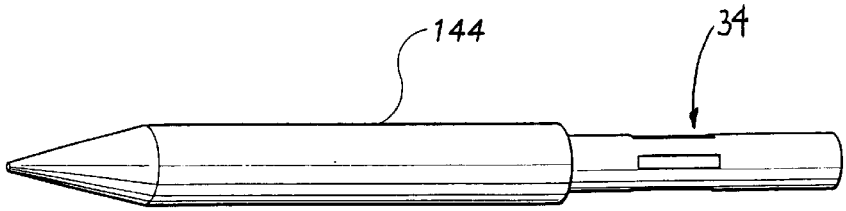
FIG. 8 is a perspective view of another alternative embodiment of a blade for use with the roofing shovel of the present invention.

It will be obvious to those skilled in the art that the blade 20 adapted for removing shingles may be removed and replaced by blades having other configurations in order to extend the functionality of the roofing shovel 10. For example, the pin 36 may be removed in order to replace the blade 20 with a blade 140, shown in FIG. 8, having a substantially straight, sharp edge 142 in order to use the roofing shovel 10 for removing not only shingles, but siding, asphalt and ceramic floor tiles, carpeting, etc. Alternatively, the blade 20 maybe replaced by a concrete vibrator 144, as shown in FIG. 9. It will also be apparent that instead of connecting the blade 20 to the bracket 40*a* by a pin 36, the shank 24 of the blade 20 may be cut below the longitudinal slots 34, and any means conventional in the industry may be used to connect the blade 20 with the shank 24, such as standard fasteners (nuts and bolts), conventional twist locks, rotary chucks, etc.

It will also be obvious to those skilled in the art that shorter, hand held versions of the roofing shovel may be made simply by making the handle 90 shorter. Further, the handle 90 may be provided with any convenient gripping means conventional in the industry, including a U-shaped grip commonly used on spade shovels.

It is to be understood that the present invention is not limited to the embodiment described above, but encompasses any and all embodiments within the scope of the following claims.

I claim:

1. A power assisted roofing shovel comprising:

a) a shovel blade, having a flat forward end and a rearward end having a reinforced hollow shank;

b) a handle, having a forward end and a rearward end;

c) a bracket for coupling said shank of said shovel blade to said handle for reciprocal longitudinal movement of said shovel blade relative to said handle, including:

i) a hollow cylindrical body having a forward end and a rearward end;

ii) a shank receiving collar on said forward end for receiving and supporting the shank of said shovel blade for reciprocal longitudinal movement of said shovel blade, the shank being slidably disposed in the shank receiving collar; and iii) a handle receiving collar on said rearward end of said bracket for receiving and fixedly coupling said forward end of said handle;

d) power assisted reciprocating means for repetitively imparting a forward movement to said shovel blade and thereafter permitting rearward movement of said shovel blade in order to allow reciprocating movement of said shovel blade between an extended position and a retracted position relative to said handle substantially along the longitudinal axis defined by said shank, said power assisted reciprocating means being disposed substantially within the body of said bracket; and e) a trigger mechanism connected to said handle for controlling said power assisted reciprocating means.

2. The roofing shovel according to claim 1, wherein the hollow cylindrical body of said bracket has a removable access panel allowing for installation and removal of said power assisted reciprocating means.

3. The roofing shovel according to claim 1, wherein said handle receiving collar is obtusely angled relative to the longitudinal axis of said shank.

4. The roofing shovel according to claim 1, wherein said forward end of said shovel blade has a plurality of notches formed therein adapted for prying roofing materials from a roof structure.

5. The roofing shovel as defined by claim 1, wherein said shovel blade has a fulcrum attached to its underside for aiding in prying operations.

6. The roofing shovel according to claim 1, further comprising a spring connected between said shovel blade and said bracket for biasing said shovel blade in a normally retracted position.

7. The roofing shovel according to claim 1, wherein:

a) said handle further comprises electrical power connecting means for connecting said roofing shovel to a source of electrical power;

b) said power assisted reciprocating means comprises:

i) an electric motor connected to said electrical power connecting means, the electric motor having a rotating shaft; and ii) power translating means for translating the rotary motion of said shaft into a forward movement of said shovel blade and thereafter permitting rearward movement of said shovel blade in order to allow reciprocating motion of said shovel blade relative to said handle along the longitudinal axis of said roofing shovel; and c) said trigger mechanism is connected to said electrical power connecting means in order to control the application of electrical power to said electric motor.

8. The roofing shovel according to claim 1, wherein:

a) said handle further comprises electrical power connecting means for connecting said roofing shovel to a source of electrical power;

b) said power assisted reciprocating means comprises:

i) a solenoid and plunger; and ii) power translating means for translating a reciprocating motion of said plunger into a forward movement of said shovel blade and thereafter permitting rearward movement of said shovel blade in order to allow reciprocating motion of said shovel blade relative to said handle along the longitudinal axis of said roofing shovel; and c) said trigger mechanism is connected to said electrical power connecting means in order to control the application of electrical power to said solenoid.

9. The roofing shovel according to claim 1, wherein the flat front end of said shovel blade has a substantially straight, sharp edge adapted for removing floor tiles.

10. The roofing shovel according to claim 1, wherein said shovel blade is removable and replaceable.

* * * * *